US005535488A

United States Patent [19]

Yao et al.

[11] Patent Number: 5,535,488

[45] Date of Patent: Jul. 16, 1996

[54] CARDING AND DRAWING SYSTEM FOR SPINNING PROCESS

[75] Inventors: Shin-Chuan Yao, Tu Cheng; Hsin-Hsiung Chiou, Taipei; Ching-Tang Huang, Yung Ho; Chin-Jung Hung, Taipei Hsien, all of Taiwan

[73] Assignee: China Textile Institute, Taipei Hsien, Taiwan

[21] Appl. No.: 393,831

[22] Filed: Feb. 24, 1995

[51] Int. Cl.[6] ..... D01G 15/10

[52] U.S. Cl. ..... 19/98; 19/239; 19/243; 19/260; 19/65 A

[58] Field of Search ..... 19/236, 239, 243, 19/115 R, 115 A, 65 A, 288, 260, 105, 98, 106 R

[56] References Cited

U.S. PATENT DOCUMENTS 5,230,125 7/1993 Clement et al. ..... 19/115 R

*Primary Examiner*—C. D. Crowder
*Assistant Examiner*—Larry D. Worrell, Jr.
*Attorney, Agent, or Firm*—Morton J. Rosenberg; David I. Klein

[57] ABSTRACT

A system for spinning is provided where a pair of carding machines are arranged side by side. A first drawn sliver is produced by feeding two carded slivers simultaneously into a sliver collector and a drafting system. The drafting system includes a pair of linear density sensors disposed at the inlet and outlet thereof and coupled to a control system for controlling the draft ratio of a first drafting zone to maintain the inlet and outlet linear density at a predetermined value.

2 Claims, 4 Drawing Sheets

CARDING AND DRAWING SYSTEM FOR SPINNING PROCESS

BACKGROUND OF THE INVENTION

1. Field of the Invention

The present invention relates to a new system of carding and drawing, which simplifies the conventional spinning process and an apparatus developed for application to improving the quality of drawn slivers.

2. Prior Art

In conventional ring spinning, a number of processing stages are involved before twisting yearn, which includes carding, drawing and roving stages. There are, at least, three drawings required to achieve a better quality of drawn sliver. If a drawn sliver is directly fed into the roving and ring frames, two drawings are normally applied. In open-end spinning, the carded sliver still has to be processed on the drafting machine twice.

Two disadvantages of the conventional spinning process are high cost of numerous processing stages and the time-consuming conveyance of sliver cans between carding and drafting.

Additionally, there are 6 to 8 carded slivers simultaneously doubled and then drafted by applying a draft ratio of 6–8 on the drawing machine. As expected, not only are the nip rollers deformed gradually, but the holding force of nip rollers on the carded slivers may not be strong enough, and cause slipping between slivers or fibers. The slipping of slivers or fibers will result in a deteriorated drafting of slivers, and produce an uneven drawn sliver.

SUMMARY OF THE INVENTION

In order to improve the aforementioned disadvantages of the conventional spinning process, a new combining process between carding and drawing is made, which includes two carding machines and a drawing apparatus. The drawing apparatus comprises a sliver collector and a drafting system with a sliver auto-leveler. By eliminating the conveyance of sliver cans between carding and drawing in this new process, the card slivers can be directly doubled and drafted on the drawing apparatus. This new process, therefore, reduces the labor required for the operation of piercing carding slivers in the drawing stage.

DETAILED DESCRIPTION OF THE INVENTION

Figure 1:
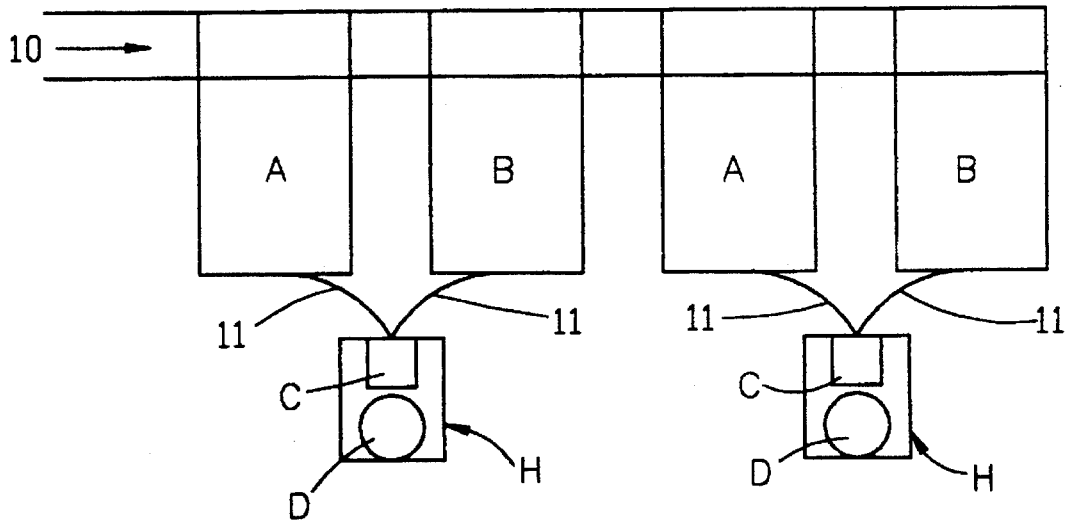
FIG. 1 is a top view showing the essential features of the present invention.

Referring to FIG. 1, two carding machines A and B are arranged side by side, and two slivers 11, produced by sending the raw materials 10 into the carding machines, are directly fed into the drawing apparatus H. The drawing apparatus H includes a sliver collector C and a drafting system D.

Figure 2:
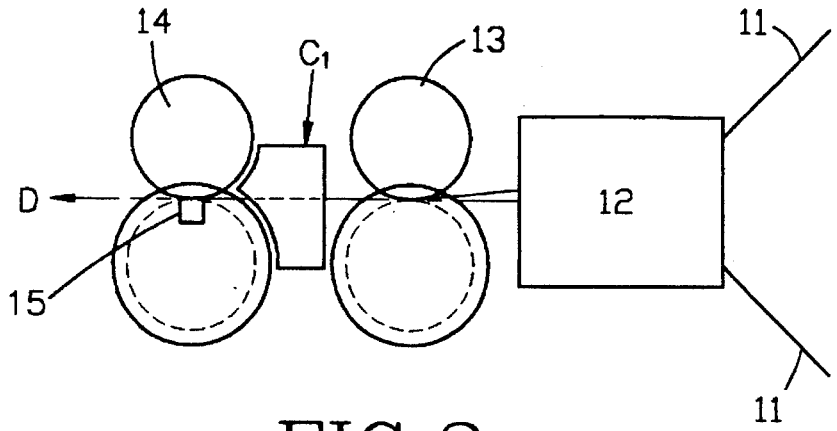
FIG. 2 is a sectional view of the sliver collector of the present invention.

In FIG. 2, sliver collector C is shown. It is necessary to arrange a proper collector because of the large distance between the outputs of the combing machines A, B. The guiding roller unit 12 guides the two slivers 11 into the grooved roller 13 located in front of the collector $C_1$. The center axis of each roller in the guiding roller unit 12 is tilted at a predetermined angle with respect to a horizontal axis thereof, to put the carded sliver 11 exactly at the center of the rollers, and a sensor 15 (also shown in FIG. 3) is used for measuring the linear density of the carded sliver coming into the drafting system D. The sensor 15 is installed in the grooved roller 14, located in back of the collector $C_1$. The width between the legs of the triangle formed between the grooved roller 14 and the collector $C_1$ is largely reduced, minimizing the detrimental influence of tension of the legs on the quality of the carding sliver.

Figure 3:
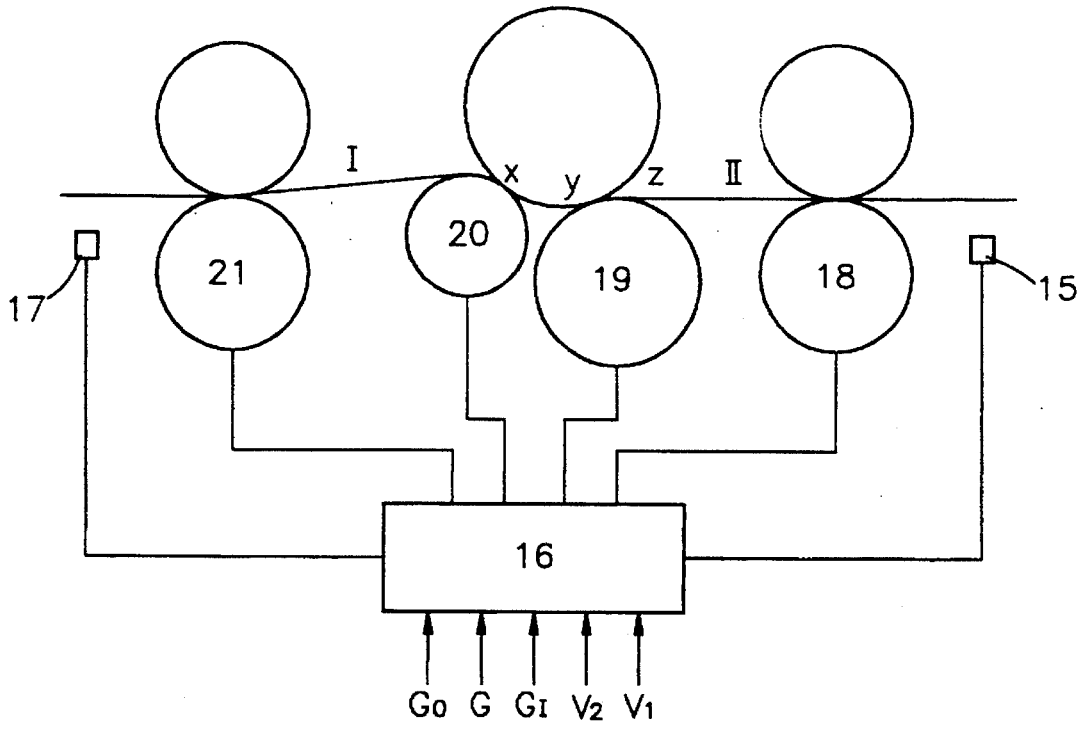
FIG. 3 is a sectional view showing the ¾ roller drafting system of the present invention.

As shown in FIG. 3, the drafting system D is shown to be a 3 over 4 roller drafting system, wherein the second drafting zone is pre-set at a constant draft. The draft ratio of the first zone is determined by control signals input to a controller 16. The controller 16 includes the motor and gear system (not shown), where the rotating speed needed for each roller 18, 19, 20 and 21 is controlled by a respective output thereof. Sensors 15 and 17 are each installed in grooved rollers respectively located at the input and the output of the drafting system for measuring the linear density of the input and output carded slivers. The controller 16 uses the input linear density $G_1$ and the output linear density $G_0$ in comparison with the ideal linear density G, to provide adjustment for correction of long term unevenness and prevention of fly-away fiber conditions during the drafting process.

Moreover, the output speeds $V_1$ and $V_2$ of the two carding machines A and B are provided to the controller 16 for controlling the required speed of the rollers.

As shown in FIG. 3, the second drafting zone of the drafting system is mainly used for constant drafting, the friction force on the front of the drafting zone is increased by the arc ZY for improving the front fiber hook. When the carded sliver moves from the second drafting zone to the first zone, adequate time is provided for the controller 16 to calculate the required output control signals. The first drafting zone is the controlling zone, the drafting ratio of it is determined by the linear density $G_1$ of the input sliver, the drafting ratio of the second drafting zone, and the required output linear density G. The friction force on the back of the first drafting zone is increased by the arc XW of this zone, for improving the back fiber hook and increasing the evenness of the carded sliver.

Figure 4B:
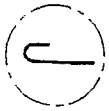
FIG. 4*b* is an enlargement of the sliver from the carding machine of FIG. 4*a* showing a trailing end hook.
Figure 4C:
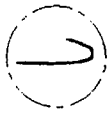
FIG. 4*c* is an enlargement of the sliver from the sliver cans of FIG. 4*a* showing a leading end hook.
Figure 4A:
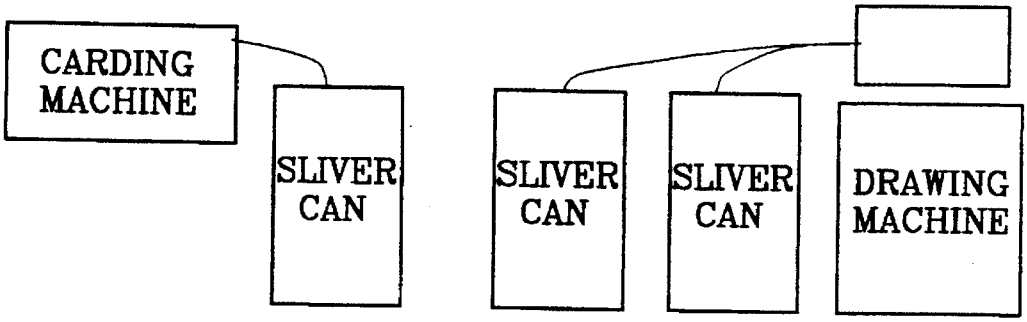
FIG.4a (PRIOR ART)
FIG. 4*a* is a diagram of hook formation in a conventional process between carding and drawing.
Figure 4E:
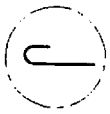
FIG. 4*e* is an enlargement of the sliver from the carding machine of FIG. 4*d* showing a trailing end hook.
Figure 4D:
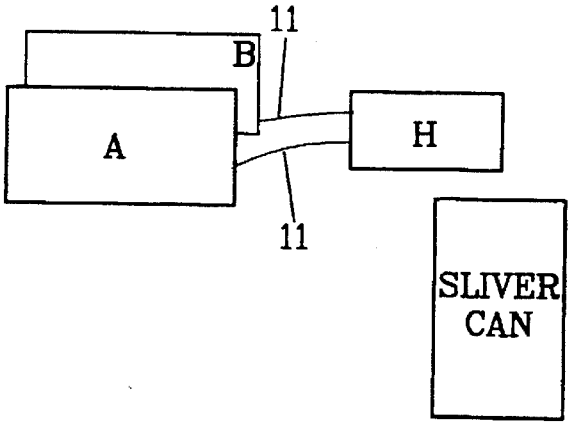
FIG. 4*d* is a diagram of hook formation of the present invention.

The features of this invention are:

1. As shown in FIG. 4*b*, the input sliver has a trailing end fiber hook, so the parallel effect of the fiber, in this invention, is obviously better than that of the conventional first draft sliver, shown in FIG. 4*a*, where the trailing end hooks become leading end hooks.

2. By linking the processes of carding and drawing directly, the steps of conveying and connecting the carded sliver are eliminated, thereby avoiding their detrimental influence on quality.

Figure 5A:
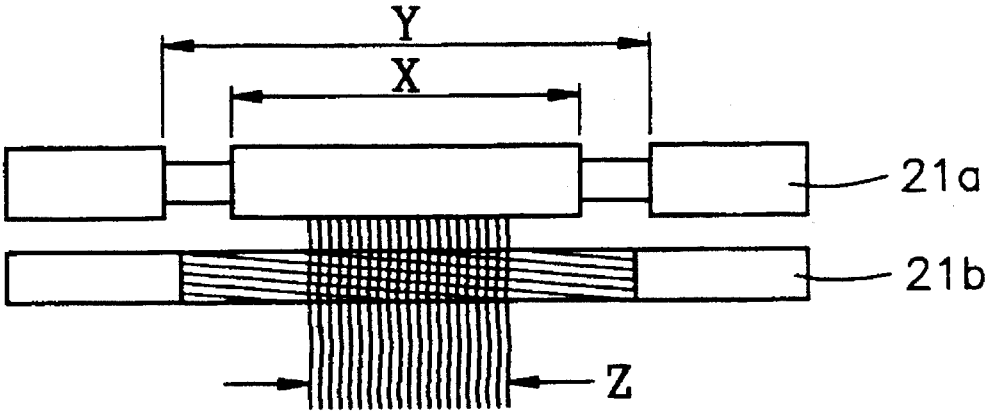
FIG.5a (PRIOR ART)
FIG. 5*a* is a diagram depicting the width of the sliver in a conventional drafting system; and, FIG. 5*b* is a diagram depicting the width of the sliver in the present invention.
Figure 5B:
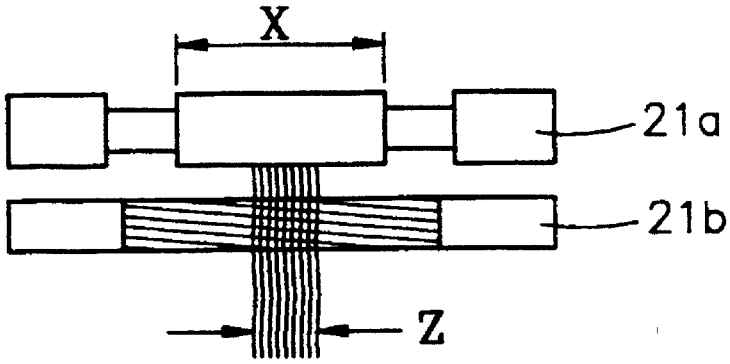

3. By incorporating only two carded slivers, the total width Z of the slivers is only 2–3 cm, as shown in FIG. 5*a*, with a roller width X of 8–10 cm. The width is ⅓ smaller than that of the conventional process which incorporates 6 to 8 slivers 8–10 cm wide, as shown in FIG. 5*a*, with a roller width X of 15–20 cm disposed within a 25–30 cm space Y. The required pressure of the rollers 21*a*, 21*b* is largely reduced in the system of FIG. 5*b*, for obtaining the same holding force on the fiber, which is helpful for the even drawing of the carded slivers.

4. The long term stabilization of the drafting system is obtained by the reduction of the drafting width and the largely decreased deformation of the rollers.

5. The production speeds of the carding machines A, B are fully matched, and the reasonable drawing speed of 200 to 400 M/min. takes a smaller risk than a 500 to 800 M/min. speed does, and the coil friction is smaller, which is helpful for shaping.

6. The width between the legs of the triangle (as shown in FIG. 2) formed between the front drafting roller of the drafting system and the collector C is largely reduced, minimizing the detrimental influence on the quality of the carded sliver by the tension of the legs.

7. The first and second drafting zones of the drafting system D are adjustable synchronously for reaching high quality with respect to linear density and unevenness, simultaneously, for the carded sliver.

Having described preferred embodiments of the present invention, it is believed that other modifications, variations and changes will be suggested to persons skilled in the art in view of the teachings set forth herein. It is therefore to be understood that all such variations, modifications and changes are believed to fall within the scope of the present invention as defined by the appended claims.

We claim:

1. A carding and drawing system for spinning processes, comprising:

a pair of carding machines, each of said pair of carding machines delivering a carded sliver therefrom;

a collector for receiving said carded sliver from each of said pair of carding machines and combining said carded slivers into a single combined sliver;

a drafting system having a sliver input for receiving said combined sliver and an output for delivering a drafted sliver, said drafting system including a plurality of rollers to define (1) a first drafting zone located adjacent said output of said drafting system and having a drafting ratio adjusted responsive to a control signal, and (2) a second drafting zone located adjacent said input of said drafting system and having a predetermined substantially constant drafting ratio;

a first sensor disposed adjacent said input of said drafting system for measuring said combined sliver to determine a first linear density value;

a second sensor disposed adjacent said output of said drafting system for measuring said drafted sliver to determine a second linear density value; and, a system for controlling operation of said drafting system having a plurality of outputs coupled respectively to said plurality of rollers, said control system having first and second inputs coupled respectively to said first and second sensors, said control system including means for generating said control signal responsive to a comparison of both said first and second linear density values with a predetermined value, said control system further including third and fourth inputs for respectively receiving output speed signals from said pair of carding machines for controlling a rotational speed of said plurality of rollers of said drafting system.

2. The carding and drawing system as recited in claim 1 where said plurality of rollers are arranged in a three over four configuration.

* * * * *